US006975830B2

(12) United States Patent
Murakami et al.

(10) Patent No.: US 6,975,830 B2
(45) Date of Patent: Dec. 13, 2005

(54) IMAGE FORMING APPARATUS, PROCESS CARTRIDGE, AND WASTE TONER RECOVERY DEVICE

(75) Inventors: Eisaku Murakami, Kanagawa (JP); Hideo Yoshizawa, Saitama (JP); Hiroyuki Nagashima, Kanagawa (JP); Yoshiyuki Kimura, Tokyo (JP); Hideki Zemba, Kanagawa (JP); Eiji Kurimoto, Shizuoka (JP); Hiroshi Ishii, Kanagawa (JP); Yuji Arai, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/660,620

(22) Filed: Sep. 12, 2003

(65) Prior Publication Data

US 2005/0036810 A1 Feb. 17, 2005

(30) Foreign Application Priority Data

Sep. 12, 2002 (JP) ..... 2002-266886
Sep. 30, 2002 (JP) ..... 2002-285333
Aug. 7, 2003 (JP) ..... 2003-288678

(51) Int. Cl.[7] ..... G03G 21/10
(52) U.S. Cl. ..... 399/358; 399/360
(58) Field of Search ..... 399/358, 359, 399/360, 120, 123, 119, 110, 99, 125, 35, 399/302, 299

(56) References Cited

U.S. PATENT DOCUMENTS 5,065,195 A * 11/1991 Haneda et al. ..... 399/358 X
5,146,270 A * 9/1992 Matsuo et al. ..... 399/358 X
6,070,037 A 5/2000 Sugihara et al. ..... 399/274
6,085,062 A 7/2000 Mizuishi et al. ..... 399/11
6,144,822 A 11/2000 Yamaguchi et al. ..... 399/121
6,148,161 A 11/2000 Usui et al. ..... 399/58
6,198,895 B1 3/2001 Tsuda et al. ..... 399/267
6,266,501 B1 7/2001 Mizuishi et al. ..... 399/106
6,337,957 B1 1/2002 Tamaki et al. ..... 399/29
6,432,596 B2 8/2002 Ikuno et al. ..... 430/58.05
6,493,528 B2 * 12/2002 Sameshima et al. .... 399/360 X
6,522,855 B1 2/2003 Katoh et al. ..... 399/274
6,553,202 B2 4/2003 Tamaki et al. ..... 399/258
6,573,016 B2 6/2003 Kami et al. ..... 430/58.05
6,641,964 B2 11/2003 Ikuno et al. ..... 430/66
6,653,033 B1 11/2003 Kami et al. ..... 430/58.05

FOREIGN PATENT DOCUMENTS

JP 07-261617 A * 10/1955
JP 5-6084 1/1993
JP 5-224472 9/1993
JP 07-261620 A * 10/1995
JP 8-202227 8/1996

(Continued)

OTHER PUBLICATIONS

U.S. Appl. No. 10/660,620, filed Sep. 12, 2003, Murakami et al.

(Continued)

*Primary Examiner*—Sophia S. Chen
(74) *Attorney, Agent, or Firm*—Oblon, Spivak, McClelland, Maier & Neustadt, P.C.

(57) ABSTRACT

An image forming apparatus includes a frame body, a frame cover supported by the frame body so as to be capable of opening and closing, an image forming unit that forms a toner image on an image carrier, a cleaning unit that removes and collects residual toner from the image carrier, and a toner container for accumulating the toner collected by the cleaning unit. The toner container is supported by the frame cover.

17 Claims, 9 Drawing Sheets

FOREIGN PATENT DOCUMENTS

| | | | | |
|---|---|---|---|---|
| JP | 08-328366 | A | * | 12/1996 |
| JP | 11-003015 | A | * | 1/1999 |
| JP | 11-095519 | A | * | 4/1999 |
| JP | 2000-131893 | | | 5/2000 |
| JP | 3198142 (B2) | | | 8/2001 |
| JP | 2001-296712 | A | * | 10/2001 |
| JP | 2002-006574 | A | * | 1/2002 |
| JP | 2002-108159 | A | * | 4/2002 |
| JP | 2002-148884 | A | * | 5/2002 |
| JP | 2002-169439 | A | * | 6/2002 |

OTHER PUBLICATIONS

U.S. Appl. No. 11/100,813, filed Apr. 7, 2005, Ojimi et al.

* cited by examiner

IMAGE FORMING APPARATUS, PROCESS CARTRIDGE, AND WASTE TONER RECOVERY DEVICE

BACKGROUND OF THE INVENTION

1) Field of the Invention

The present invention relates to a technology for removing and collecting residual toner.

2) Description of the Related Art

Image forming apparatuses, such as the printers, require replenishment of consumed articles, or replacement of latent image carriers, developing devices, or intermediate transfer bodies with new ones. The users check the components, and, if necessary, do the replacement.

FIG. 17 illustrates a conventional printer. The printer has frame covers 101, 102, and 56 which are fixed to a frame body 100 so that the covers are pivotably open. Inside the frame body 100, a latent image carrier, an exposing device, a developing device, a transfer device, an intermediate transfer belt 31, toner bottles 57Y, 57M, 57C, and 57K ("toner bottles 57"), a waste toner container 103, a cleaning device, and a fixing device are provided. Among these, the latent image carrier, the developing device, and the cleaning device are formed as one image forming unit. The image forming unit is often used as a process cartridge that is detachably attached to the frame body. Further, the intermediate transfer belt 31 and another component are sometimes formed as one intermediate transfer unit. A user opens the frame cover 56 for checking the apparatus and detaches the image forming unit or the intermediate transfer belt 31 from the frame body. If the toner inside any of the toner bottles 57 is decreased to a predetermined amount or less, the user opens the frame cover 56 and exchanges the toner bottle with another toner bottle filled with toner to replenish the toner. Further, the user disposes of the waste toner before the waste toner container 103 becomes full.

Conventionally, various methods of replenishing a container with toner and disposing of waste toner have been proposed in order to improve operability for maintenance. For example, in the image forming apparatus disclosed in Japanese Patent Application Laid Open No. Hei 5-6084, one container is used for non-used toner and a waste toner.

When the image forming unit or the intermediate transfer belt 31 is to be replaced with a new one, the user has to demount the container 103 first, although the container 103 does not need to be replaced, to have a reach to the image forming unit or the intermediate transfer belt. This reduces the operability and convenience. Moreover, where to place the demounted container is a problem. Sometimes the toner scatters inside of the apparatus or on the user.

SUMMARY OF THE INVENTION

It is an object of the present invention to solve at least the problems in the conventional technology.

An image forming apparatus according to one aspect of the present invention includes a frame body; a frame cover supported by the frame body so as to be capable of opening and closing; an image forming unit that forms a toner image with toner on an image carrier; a cleaning unit that removes and collects toner residing on the image carrier; and a toner container for accumulating the toner collected by the cleaning unit, wherein the waste toner container is supported by the frame cover.

A process cartridge according to another aspect of the present invention is used in an image forming apparatus. The image forming apparatus including a frame body; a frame cover supported by the frame body so as to be capable of opening and closing; an image forming unit that forms a toner image with toner on an image carrier; a cleaning unit that removes and collects toner residing on the image carrier; and a toner container for accumulating the toner collected by the cleaning unit. The toner container is supported by the frame cover, and at least one unit selected from the image forming unit and the cleaning unit is integrally formed with the image carrier. The process cartridge has an arrangement so that the process cartridge can be detachably attached to the frame body.

A waste toner recovery device according to still another aspect of the present invention includes a toner container, detachably attached to an image forming apparatus, for collecting waste toner produced in the image formation process by the image forming apparatus, the toner container including a conveying unit for moving the waste toner inside the toner container. The toner container has a shape that fits in a space inside the image forming apparatus.

The other objects, features and advantages of the present invention are specifically set forth in or will become apparent from the following detailed descriptions of the invention when read in conjunction with the accompanying drawings.

DETAILED DESCRIPTION

Figure 1:
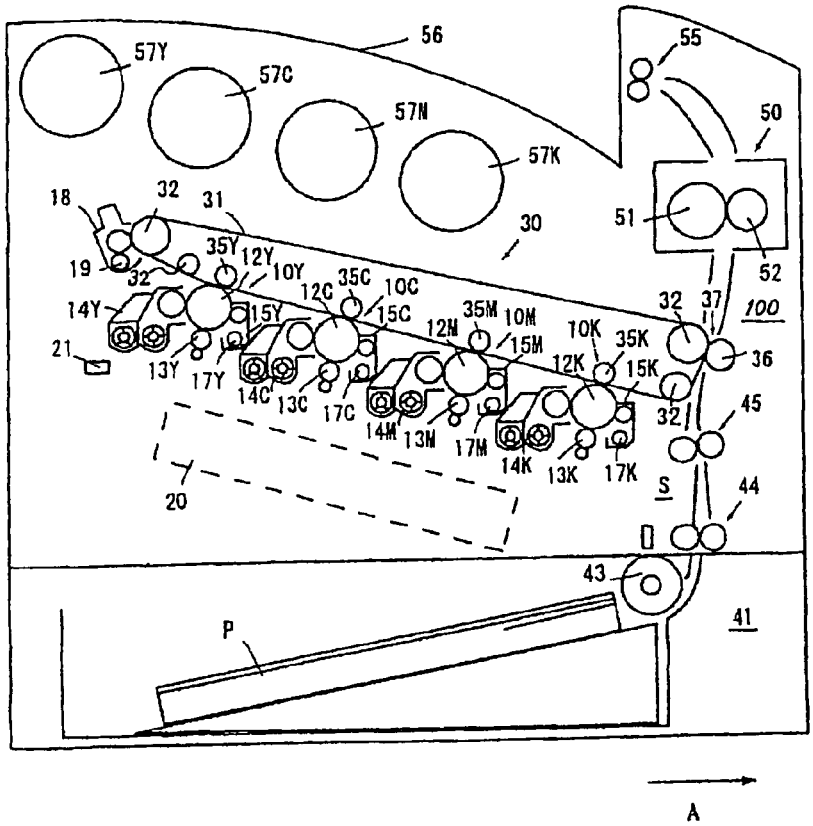
FIG. 1 is a side view of internal structure of a printer according to an embodiment of the present invention.
Figure 2:
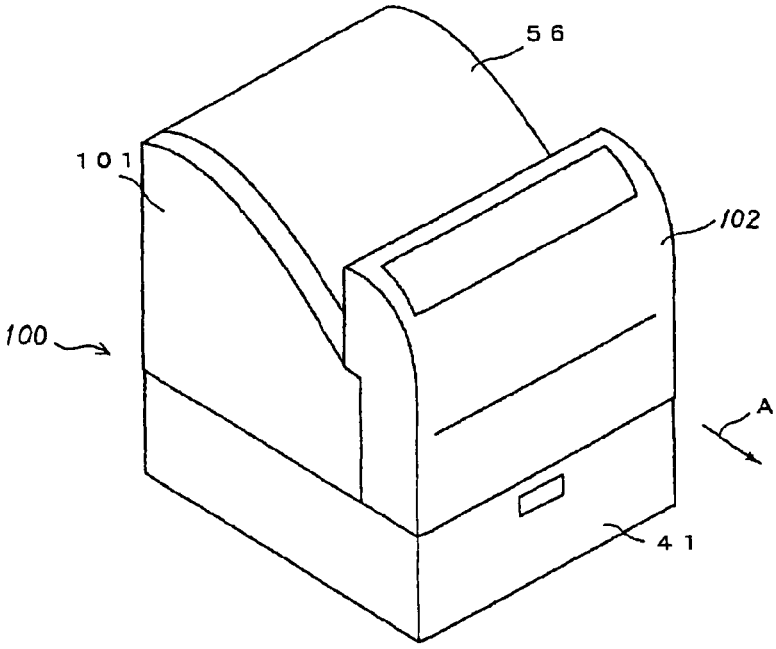
FIG. 2 is a perspective view of the printer shown in FIG. 1.
Figure 3:
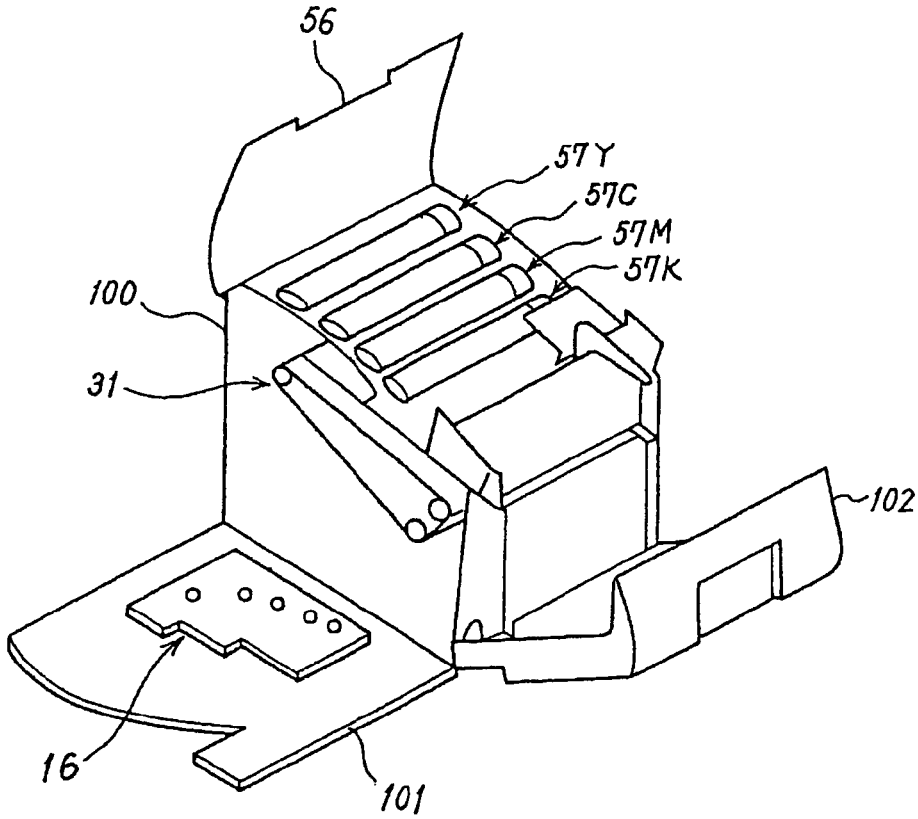
FIG. 3 is a perspective view of the printer when frame covers are opened.

Exemplary embodiments of the present invention that is applied to a full color printer (hereinafter, "printer") as an image forming apparatus will be explained below with reference to the drawings. FIG. 1 schematically illustrates an internal structure of the printer. FIG. 2 is a perspective view of an appearance of the printer. FIG. 3 is a perspective view of an appearance of the printer when the covers of the printer are open. As shown in FIG. 1 to FIG. 3, the printer includes a frame body 100 in which positions of accommodating components as image forming units are fixed, and a paper feed cassette 41 as a paper feed unit that stocks transfer paper P as recording materials. Assuming the direction indicated by the arrow A is a front side to which the paper feed cassette 41 is pulled out, the frame body 100 has a left-side frame cover 101 supported by the left side of the frame, and has a front-side frame cover 102 supported by the front side of the frame. Both of the covers can be freely opened and closed. The frame body 100 also has a paper discharge tray 56 on the top face thereof, and the tray 56 is also opened and closed in the vertical direction in the figure. When the left-side frame cover 101 is opened, the waste toner container is detachable from the frame body 100 as explained later. When the paper discharge tray 56 is opened, toner bottles 57Y, 57C, 57M, and 57K that accommodate toners of yellow (Y), cyan (C), magenta (M), and black (K) are detachable from the frame body 100.

The structure and operation of the printer will be explained below. The printer includes image forming cartridges 10Y, 10C, 10M, and 10K ("cartridges 10") provided in the central portion inside the frame body 100 as shown in FIG. 1. More specifically, the cartridges 10 form images with yellow (Y), cyan (C), magenta (M), and black (K) toners, respectively. An optical unit 20 as an exposing unit is provided below the cartridges 10, and radiates photoreceptive drums 12Y, 12C, 12M, and 12K each as an image carrier, with laser beams. An intermediate transfer unit 30 having an intermediate transfer belt 31 is provided in the upper side of the cartridges 10. The intermediate transfer belt 31 sometimes serves as an image carrier or an intermediate transfer body to which the toner images formed by the image forming cartridges 10 are secondarily transferred. The printer also has a fixing unit 50 that fixes the toner image transferred to the intermediate transfer belt 31, on the transfer paper P.

Figure 4:
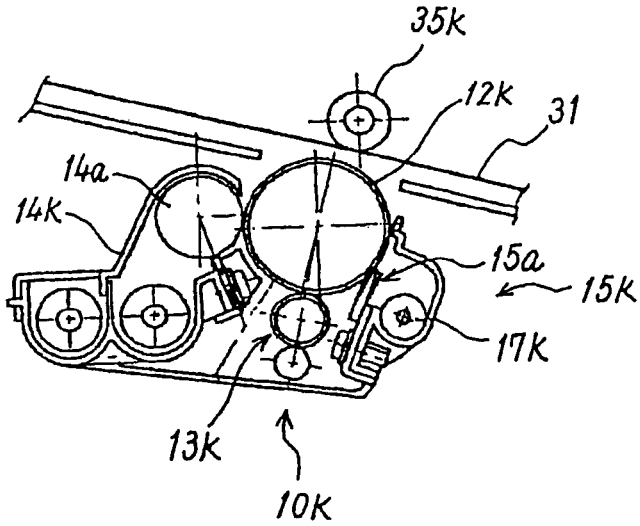
FIG. 4 is a side view of internal structure of an image forming cartridge for black.

Since the image forming cartridges 10Y, 10C, 10M, and 10K have the same structure, the cartridge 10K for black is explained below. FIG. 4 illustrates the internal structure of the image forming cartridge for black. The cartridge 10K includes the photoreceptive drum 12K, a charger 13K that charges the drum 12K, and a developing device 14K that develops a latent image formed on the drum 12K. Chargers 13Y, 13C, 13M and developing devices 14Y, 14C and 14M are used for the colors; yellow, cyan, and magenta respectively. The cartridge 10K also includes a cleaning device 15K that removes waste toner such as non-transferred toner as a developer remaining on the drum 12K, and also removes paper dust. The cleaning device 15K has a cleaning blade 15*a* to clean the surface of the drum 12K. The cleaning blade 15*a* may be a cleaning roller as shown in FIG. 1. As explained above, the cartridge 10K integrally supports the photoreceptive drum 12K, charger 13K, developing device 14K, and the cleaning device 15K to form a process cartridge that is detachably attached to the frame body 100.

The intermediate transfer unit 30 includes the intermediate transfer belt 31 and primary transfer rollers 35Y, 35C, 35M, and 35K. The intermediate transfer belt 31 is stretched and supported by four rollers 32, and the rollers 35Y, 35C, 35M, and 35K are used for transferring the toner images formed on the photoreceptive drums 12Y, 12C, 12M, and 12K to the intermediate transfer belt 31. The intermediate transfer unit 30 further includes a secondary transfer roller 36 that transfers the toner image on the intermediate transfer belt 31 further to the recording paper P. The toner image on the belt 31 is transferred to the paper P at a secondary transfer region 37 as a contact part between the belt 31 and the roller 36. The intermediate transfer unit 30 has a belt cleaning device 18 that cleans off the toner that has failed to be transferred to the paper P and remains on the belt 31.

The transfer paper P in the paper feed cassette 41 is conveyed to the secondary transfer region 37 by a paper feed roller 43 disposed near the cassette 41 and transfer rollers 44. Registration rollers 45 are disposed on a transfer paper conveying path between the transfer rollers 44 and the secondary transfer region 37. The rollers 45 control timing of sending the fed recording paper P to the secondary transfer region 37.

The fixing unit 50 has a fixing roller 51 and a pressurizing roller 52, and fixes the transferred toner image on the paper P with heat and pressure. Paper discharge rollers 55 discharge the paper P with the image fixed onto the paper discharge tray 56.

The toner bottles 57Y, 57C, 57M, and 57K that accommodate color toners of Y, C, M, and K are mounted on the upper side of the frame body 100. The developing devices 14 of the image forming cartridges 10 are replenished with toners filled in the toner bottles 57 as required. The toner bottles 57Y, 57C, 57M, 57K are dismountable from the frame body 100 when the paper discharge tray 56 is opened, as shown in FIG. 3. If the toner amount in the toner bottle 57 is decreased to a predetermined amount or less, the user exchanges the bottle with a new bottle filled with toner.

If an image is formed only with black color in the above structured printer, the charger 13K uniformly charges the photoreceptive drum 12K in the image forming cartridge 10K. Subsequently, the optical unit 20 performs exposure by scanning the drum 12K with a laser beam according to image formation to form a latent image on the surface thereof. The latent image on the drum 12K is developed with black toner carried on the developing roller 14*a* of the developing device 14K to be visualized as a toner image. The toner image formed on the drum 12K is transferred to the intermediate transfer belt 31 by the action of a primary transfer roller 35K. After the primary transfer is finished, the cleaning device 15K cleans the surface of the photoreceptive drum 12K to be in a standby state for the following image formation. The transfer paper P is fed into the frame body 100 by the paper feed roller 43 and the transfer rollers 44. The toner image formed on the intermediate transfer belt 31 is transferred to the paper P at the secondary transfer region 37. The transfer paper P on which the toner image is transferred passes through the fixing unit 50, where image is fixed, and the paper discharge rollers 55 discharge the paper P onto the paper discharge tray 56 formed on the top face of the frame body 100. The belt cleaning device 18 in contact with the transfer belt 31 cleans the non-transferred toner remaining on the transfer belt 31 in the same manner as that of the photoreceptive drum 12.

In the above structured printer, if a color image is to be formed, an image forming process the same as that for the black color is carried out in the image forming cartridges 10Y, 10C, 10M, and 10K to form toner images of the colors on surfaces of the photoreceptive drums 12Y, 12C, 12M, and 12K, respectively. The toner images formed on the drums 12Y, 12C, 12M, and 12K are sequentially and superposedly transferred to the transfer belt 31 by primary transfer bias rollers 35Y, 35C, 35M, and 35K in order of black, magenta, cyan, and yellow. The transfer belt 31 is driven to rotate in a counterclockwise direction. The transfer paper P is conveyed by the paper feed roller 43 and the registration rollers 44 from the paper feed cassette 41 toward the transfer region 37. The toner image formed on the transfer belt 31 is collectively transferred to the transfer paper P by the action of the secondary transfer roller 36. The transfer paper P with the toner image transferred is conveyed to the fixing unit 50, where the toner image is fixed at a fixing nip region formed with the fixing roller 51 and pressurizing roller 52. The paper discharge rollers 55 discharges the paper onto the paper discharge tray 56. The rollers 55 are disposed on the downstream side of the fixing unit 50 in a direction of conveying the transfer paper.

The toner bottles 57, the intermediate transfer belt 31, and the image forming cartridges 10 are disposed slantingly in the same direction with respect to the frame body 100, and therefore, the whole length of the frame body 100 is reduced to achieve its minimization. Among the image forming cartridges 10Y, 10C, 10M, and 10K, the image forming cartridge 10K that forms a black toner image is disposed so as to be on the side of the secondary transfer region 37. The image forming cartridges are step-formed so that the cartridge 10K is disposed lower than the cartridge 10Y. This is because even in the color printer, images using only black are most frequently formed and therefore, the cartridge 10K is disposed on the side of the secondary transfer region 37 in order to reduce a time required for printing an image of black color. By disposing slantingly the devices in the frame body 100, the frame body 100 has a space S formed between the image forming cartridges 10 and the paper feed cassette 41. When the left-side frame cover 101 is closed, the waste toner container 16 is fitted in this space S.

The non-transferred toner that fails to be transferred to the intermediate transfer belt 31 and remains on the photoreceptive drums 12Y, 12C, 12M, and 12K is recovered by the cleaning devices 15Y, 15C, 15M, and 15K ("cleaning devices 15") as first cleaning units. Each of the cleaning devices 15 recovers the non-transferred toner remaining on the drum 12 by the cleaning roller, and a waste toner conveying unit 17 conveys the toner to the recovered waste toner container 16.

The waste toner container 16 is held integrally with the left-side frame cover 101 as shown in FIG. 3. Therefore, by opening the left-side frame cover 101 for maintenance of the apparatus, each of the image forming cartridges 10 and the intermediate transfer belt 31 can be taken out without dismounting the waste toner container 16. Even if any trouble occurs suddenly in any of the image forming cartridges 10 and the intermediate transfer belt 31 and components are required to be replaced, there is no need to dismount the waste toner container 16. Therefore, for the maintenance, the user does not need to find out a right place for the waste toner container 16 to be put on, and toner drops from the waste toner container 16 can be suppressed to the minimum. Further, if the container 16 ensures an estimated capacity for the amount of waste toner to be accommodated therein by the time the life of the apparatus is ended, there is no need to replace the container 16 with a new one, which can achieve maintenance free. As explained above, by holding the waste toner container 16 integrally with the left-side frame cover 101, the operability and convenience in use for maintenance can be improved.

Figure 5:
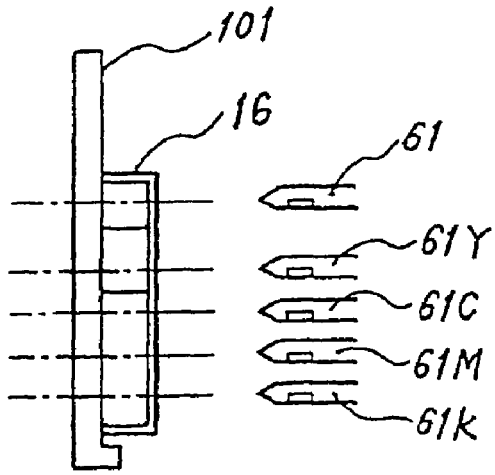
FIG. 5 is a side view of a left-side frame cover and waste toner containers.

FIG. 5 is a side view of the structure of the left-side frame cover and waste toner containers. The waste toner recovered by the cleaning devices 15Y, 15C, 15M, and 15K is conveyed to the waste toner container 16 through conveying pipes 61Y, 61C, 61M, and 61K connected to waste toner conveying units 17Y, 17C, 17M, and 17K. The waste toner recovered by the belt cleaning device 18 is conveyed to the waste toner container 16 through a conveying pipe 61 connected to a waste toner conveying unit 19. At this time, the tips of the conveying pipes 61, 61Y, 61C, 61M, and 61K connected to the waste toner conveying units 17 and 19 are fitted to the waste toner container 16. In such a structure, only the image forming cartridges 10 can be easily replaced, thus improving operability. Even if the life of the image forming cartridges 10 is elongated, there is no need to increase the capacity of the waste toner container provided on the side of the image forming cartridges 10. Therefore, even the image forming cartridges 10 having long life can be made compact in size and cost reduction can be achieved.

Figure 6:
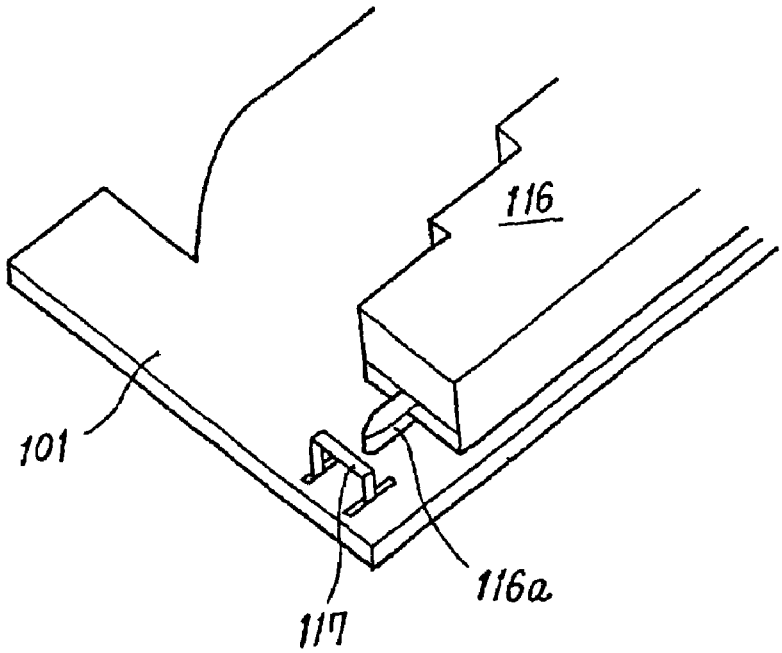
FIG. 6 is a perspective view of a portion of another waste toner container formed discretely from the left-side frame cover.

Further, the waste toner container 16 as shown in FIG. 5 is formed integrally with the left-side frame cover 101 and held thereby, but the container 16 may be formed as a discrete unit and is held by the left-side frame cover 101. FIG. 6 is a perspective view of the waste toner container formed as a discrete unit that is not fixed to the left-side frame cover. As shown in FIG. 6, a waste toner container 116 is formed as a discrete unit and held by the left-side frame cover 101. The waste toner container 116 has a projection 116*a* formed at the end thereof, and this projection 116*a* is fitted into a slide member 117 provided on the left-side frame cover 101 and thereby the container 116 is held by the left-side frame cover 101. The slide member 117 is then slid to enable dismounting of the waste toner container 116 from the frame cover 101.

The waste toner container 116 is held by the left-side frame cover 101 in the above-explained manner. Therefore, by opening the left-side frame cover 101 for maintenance of the apparatus, it is possible to take out the image forming cartridges 10 and the intermediate transfer belt 31 without dismounting of the waste toner container 116. Even if any abnormal event suddenly occurs in the cartridges 10 and the transfer belt 31 and any of the components needs to be replaced, there is no need to dismount the recovered waste toner container 116. Therefore, the user no longer cares about a right place for the container 116 to be put on during the maintenance, and it is possible to minimize toner drops from the container 116. By holding the waste toner container 116 by the left-side frame cover 101, it is possible to improve the operability and convenience in use for maintenance of the apparatus. Further, the container 116 is dismountable and replaceable with a new waste toner container, and therefore, the capacity of the container 116 can be reduced to smaller size than that of the waste toner container 16, and space savings can be achieved.

Figure 7:
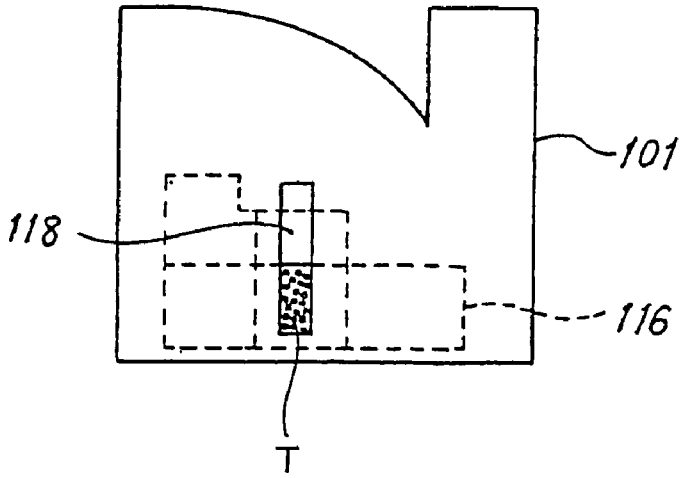
FIG. 7 is a side view of the waste toner container shown in FIG. 6.

Further, it may be designed to visually check the amount of waste toner T in the container 116 from outside in order to determine the time to replace the waste toner container 116. FIG. 7 is a front view of the structure of the left-side frame cover and the waste toner container. The left-side frame cover 101 has a window 118 made of transparent resin such as acrylic resin. The window 118 is provided at a part of the face in contact with the waste toner container 116. The amount of the waste toner T in the container 116 can be visually checked from the outside through this window 118. By molding the waste toner container 116 with the transparent resin, the amount of waste toner T in the container 116 may also be visually checked from the outside.

As explained above, the amount of waste toner T in the waste toner container 116 can be visually checked from the outside. Therefore, there is no need to particularly provide a waste-toner full amount detector in the container 116. The user can find, without using the detector, the time when the container 116 should be replaced, and can prepare another waste toner container in advance. Since the waste-toner full amount detector is not needed, cost reduction of the apparatus can be achieved.

Figure 8:
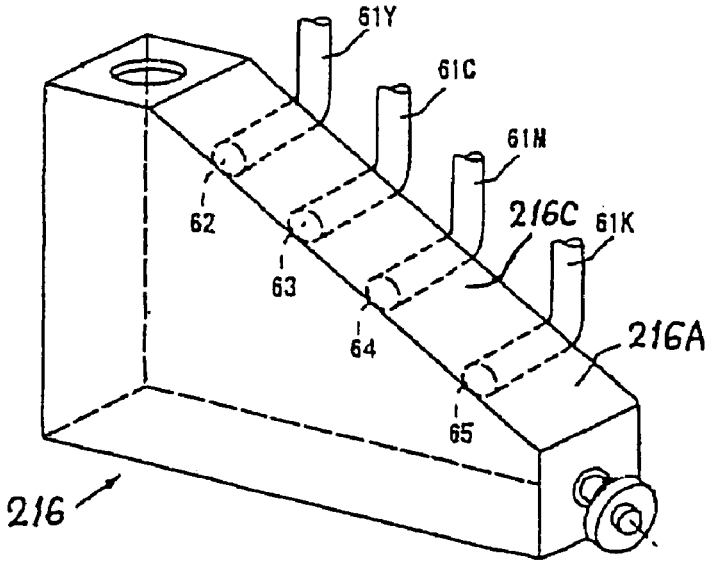
FIG. 8 is a perspective view of a waste toner container in another embodiment.

The waste toner container shown in FIG. 3 is formed in such a manner that the side of the container facing the cleaning device is step-formed so as to fit the space S formed in the frame body 100, but the form of the container is not particularly limited. FIG. 8 is a perspective view of a waste toner container having a different form from the waste toner container of FIG. 1. For example, a waste toner container 216 has a top face 216A as a side facing the cleaning devices 15Y, 15C, 15M, and 15K. The top face 216A is inclined so as to be substantially parallel with a line L (see FIG. 9) connecting rotational centers of the photoreceptive drums 12Y, 12C, 12M, and 12K. The waste toner container 216 shown in FIG. 8 has, for example, introduction holes 62, 63, 64, and 65 formed in a side face 216C thereof, and the conveying pipes 61Y, 61C, 61M, and 61K are connected to the holes 62, 63, 64, and 65 from the side face 216C, respectively.

Figure 9:
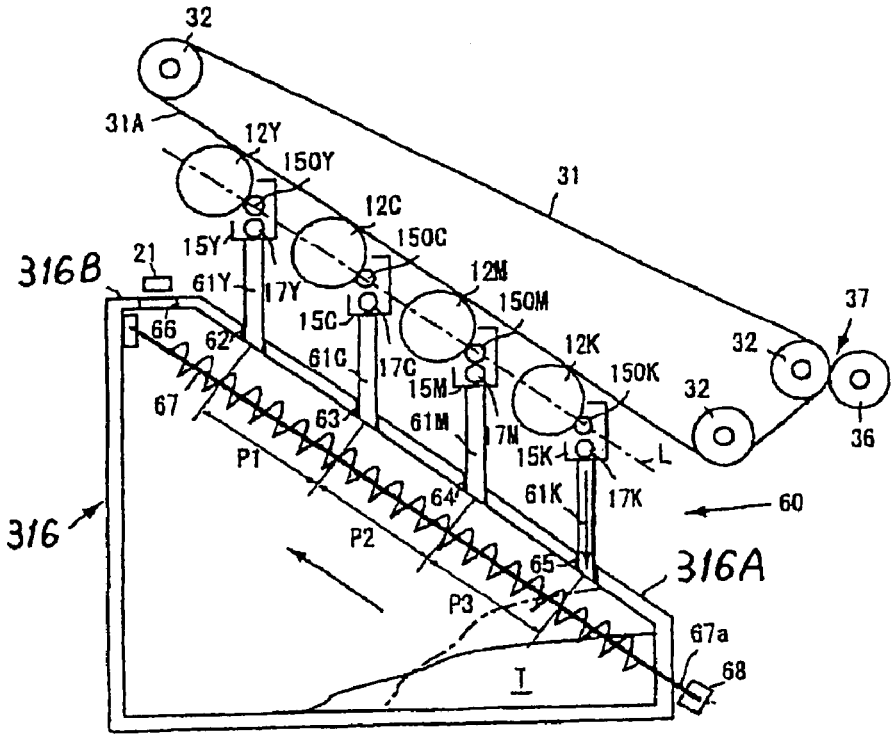
FIG. 9 is a perspective view of a waste toner container in still another embodiment.

FIG. 9 is a perspective view of the waste toner container with introduction holes provided on the top face of the container. A waste toner container 316 shown in FIG. 9 has a top face 316A as a side facing the cleaning devices 15Y, 15C, 15M, and 15K in the same manner as the container 216 shown in FIG. 8. The top face 316A is inclined so as to be substantially parallel with the line L connecting the rotational centers of the photoreceptive drums 12Y, 12C, 12M, and 12K. As shown in FIG. 9, the line L also serves as a line connecting the cleaning units 150Y, 150C, 150M, and 150K of the cleaning devices 15. The container 316 has introduction holes 62, 63, 64, 65, and 66 formed on the top face 316A and a highest top face 316B. The holes 62, 63, 64, and 65 are connected to one ends of the conveying pipes 61Y, 61C, 61M, and 61K ("conveying pipes 61"), respectively. Intervals P1, P2, and P3 of the conveying pipes 61Y, 61C, 61M, and 61K are set to equal to one another. By making the top face 316A parallel with the line L like the waste toner container 316, the distance between the top face 316A and the cleaning devices 15 is set constant, and the length of the conveying pipes 61Y, 61C, 61M, and 61K is made equal to one another, which makes it possible to share the components. An opening 66 formed on the highest top face 316B of the container 316 is connected with a toner conveying path (not shown) communicating the transfer screw 19 of the belt cleaning device 18 (see FIG. 1). In such a structure, the waste toner cleaned by the cleaning device 15 and the belt cleaning device 18 can be recovered into the waste toner container.

A conveying unit for internally conveying toner T to be accommodated may be provided inside the waste toner container 216. A screw conveyor 67 as a conveying unit for conveying waste toner T recovered in the container is provided inside the waste toner container 316 as shown in FIG. 9. The screw conveyor 67 is continuously extended along and below positions facing the introduction holes 62, 63, 64, and 65. Both ends of the screw conveyor 67 are rotatably supported by the waste toner container 316, and an end part 67*a* positioned on the lower side of the container 316 is projected toward the outside of the container 316. The projected end part 67*a* is fixed with a spur gear 68 to which drive force is transmitted so that the spur gear 68 and the screw conveyor 67 are integrally rotatable. The screw conveyor 67 is disposed in such a manner that if the member 67 is rotated in either right or left direction, the waste toner T inside the container can be conveyed in a direction away from the introduction holes. As shown in FIG. 9, the screw conveyor 67 is extended from the lower side of the inclined top face 316A toward the highest top face 316B so that the toner is conveyed from the lower side to the higher side of the waste toner container 316 as shown by arrow 60. When the drive force is transmitted to the screw conveyor 67 to rotate, the waste toner T is conveyed from the lower side toward the higher side of the container 316.

According to the waste toner container 316 having such a structure, the waste toner recovered by the cleaning devices 15 passes through the conveying pipes 61 from the conveying screws (waste toner conveying units) 17 to be recovered into the waste toner container 316 through the introduction holes 62, 63, 64, and 65. As the container 316 has the inclined top face 316A, the height inside the container is different at positions. Therefore, each amount of toner that can be deposited is different from one another depending on the positions. If the same amount of waste toner is recovered from each of the conveying pipes 61, the lower part below the introduction hole 65 connected with the conveying pipe 61K has a lower limit to toner deposition as compared with that of the lower part below the introduction hole 62. This is because the heights of the container 316 from the bottom face up to the top face 316A are different. Therefore, if a sensor 21 detects the amount of toner deposited through the introduction hole 62, the amount of toner deposited through the introduction hole 65 is over-flown, which may cause leakage of toner from the introduction hole 65 or clogging in the conveying pipe 61K.

The waste toner container 316 shown in FIG. 9 has the screw conveyor 67, that is driven to rotate, provided inside thereof. The waste toner deposited at the lower part is conveyed up to the higher part by the screw conveyor 67, and thereby a heap of the waste toner at the lower part in the container 316 is collapsed. Consequently, it is possible to resolve leakage of the waste toner from the introduction hole 65 and clogging in the conveying pipe 61K of the container 316, or resolve adhesion of the toner to the container 316. Therefore, the waste toner can be efficiently filled in the container 316. Further, the introduction holes 62, 63, 64, and 65 are provided in the waste toner container 316, and the holes are connected to the conveying pipes 61Y, 61C, 61M, and 61K, respectively, and therefore the waste toner can be efficiently recovered.

An opening for detection may be provided on the highest top face 316B as a highest position of the waste toner container 316. The opening is provided for the sensor 21 as a full amount detector that detects how the internal side of the container is filled with the recovered waste toner. The sensor 21 is mounted on the frame body 100 so that the sensor 21 is positioned above the container 316 when the container 316 is mounted on the frame body 100. Therefore, even when the waste toner container 316 is replaced, the sensor 21 is avoided from being replaced together with the container. Thus, it is possible to prevent unnecessary replacement of components and reduce the cost of the waste toner container 316.

Figure 10:
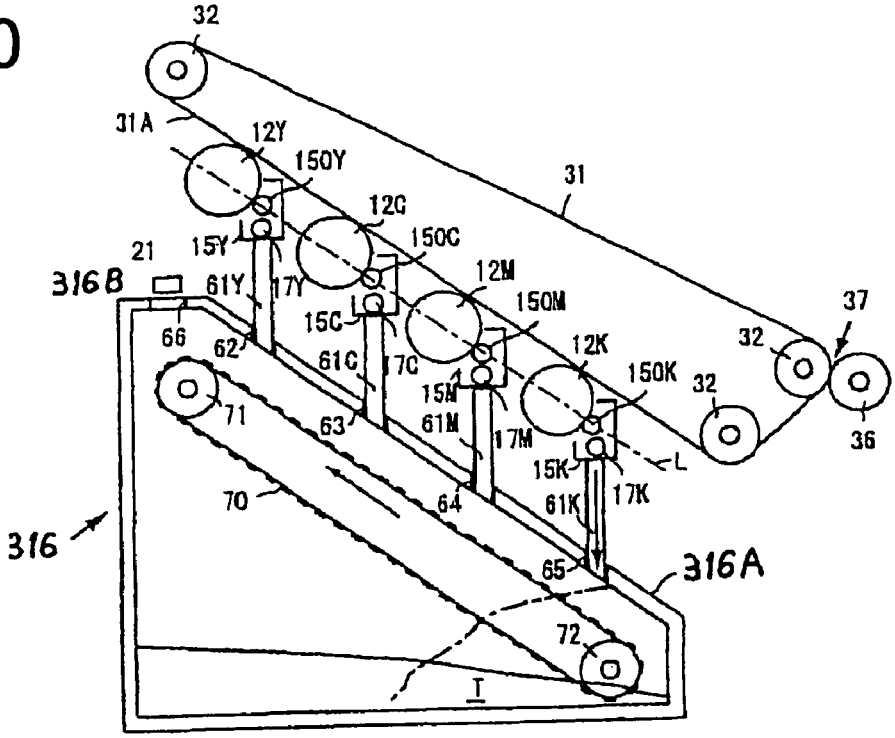
FIG. 10 illustrates how a belt conveys the toner.

FIG. 10 illustrates the waste toner container when a belt is used as a conveyor. The waste toner container 316 uses a belt 70 as the conveyor. The belt 70 is internally arranged in the container 316 and is wound around between pulleys 71 and 72 that are rotatably supported. Many steps are formed on the peripheral surface of the belt 70, and therefore, the belt 70 is formed so as to easily convey the waste toner T. Of the pulleys 71 and 72, the pulley 71 is disposed on the opening 66 side, and the pulley 72 is disposed on the lower side of the introduction hole 65. Therefore, the belt 70 is arranged so as to be inclined downward in a right direction in FIG. 10, that is, the pulley 72 is positioned at a lower side. The drive force is transmitted from the drive unit (not shown) to the pulley 72 to move the belt 70 in the counter-clockwise direction in FIG. 10.

Even if the conveyor is formed with the belt 70, the belt 70 can convey the waste toner deposited at the lower part toward a higher part, thereby a heap of the waste toner deposited at the lower part in the container is collapsed. It is, therefore, possible to resolve the leakage of the waste toner from the introduction hole 65 and clogging in the conveying pipe 61K, or resolve adhesion of the toner to the waste toner container 316, thus the waste toner can be efficiently filled in the container 316.

Figure 11:
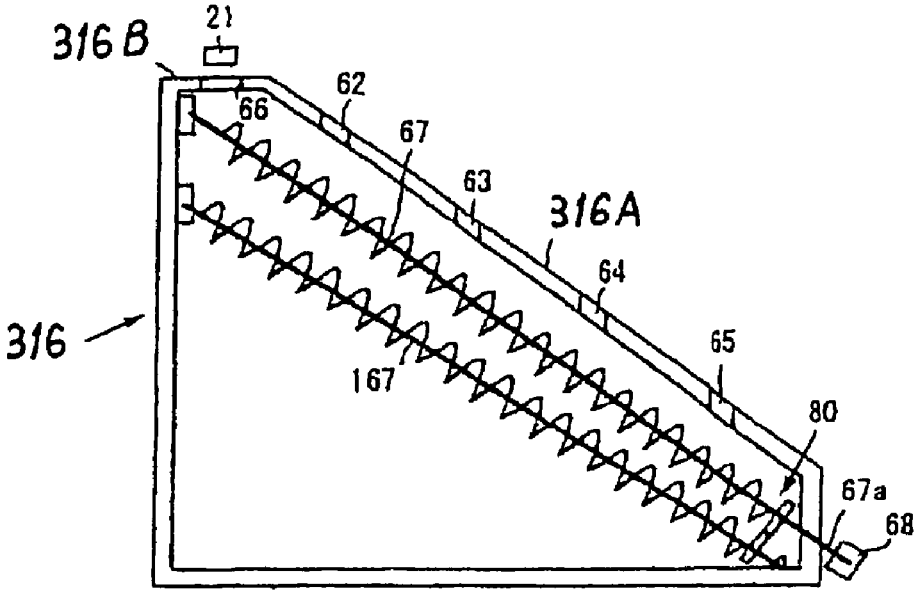
FIG. 11 illustrates how a plurality of conveyors convey the toner.

FIG. 11 illustrates the waste toner container when a plurality of conveyors are provided. The waste toner container 316 as shown in FIG. 11 has screw conveyors 67 and 167 as the conveyors provided inside the container. The container itself has the same structure as that of the container shown in FIG. 9. The screw conveyor 167 has the same structure as that of the screw conveyor 67, and is coupled to the screw conveyor 67 through a train of gears 80 as a coupler. When the screw conveyor 67 is rotated, the screw conveyor 167 is rotated in the same direction.

By providing the screw conveyors 67 and 167 in the waste toner container 316, the waste toner deposited at the lower part can be efficiently conveyed toward the higher part. Therefore, it is possible to resolve leakage of the waste toner from the introduction hole 65 and clogging in the conveying pipe 61K, or resolve adhesion of the toner to the container 316. Thus, the waste toner can be efficiently filled in the container 316. It is noted that two lines of the screw conveyors 67 and 167 are arranged as the conveyors in FIG. 11, but the number of lines or the form of the conveyor is not thus limited. For example, in the structure as shown in FIG. 10, the belt 70 may be arranged in plurality in the direction of bus bur of the pulleys 71 and 72, or the belts 70 may be vertically arranged inside the container 316 as shown in FIG. 11.

Figure 12:
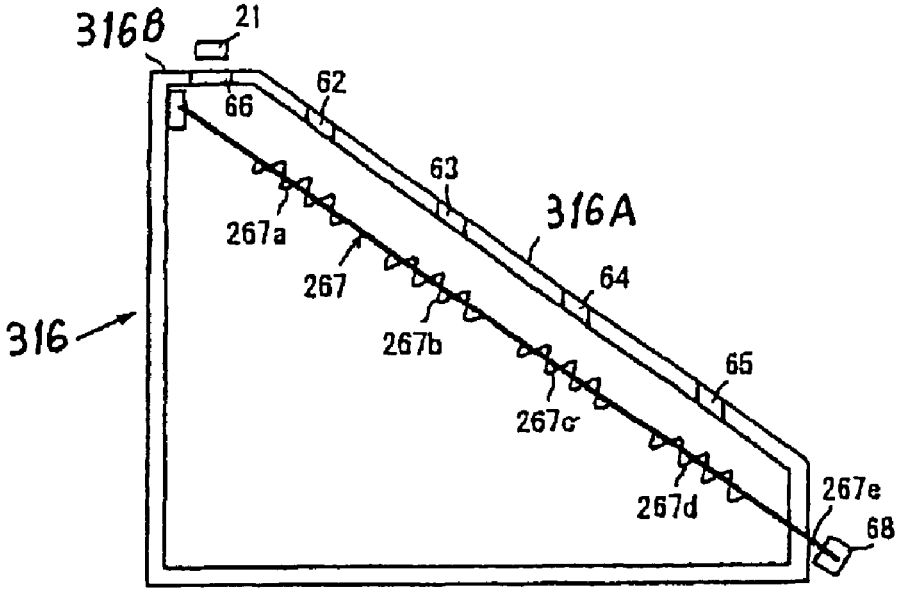
FIG. 12 illustrates a case when conveyors are provided only at positions facing the introduction holes.

FIG. 12 illustrates the structure of the waste toner container when conveyors are provided only at positions facing the introduction holes. Screws parts 267*a,* 267*b,* 267*c,* and 267*d,* as the conveyors, are provided inside the waste toner container 316 as shown in FIG. 12. The screw parts 267*a,* 267*b,* 267*c,* and 267*d* are partially formed only at positions corresponding to the introduction holes 62, 63, 64, and 65. The screw conveyor 267 is rotatably supported by the waste toner container 316, and an end part 267*e* positioning on the lower side is projected to the outside of the container 316. The projected end part 267*e* is fixed with a spur gear 68 to which drive force is transmitted so that the spur gear 68 and the screw conveyor 267 are integrally rotatable. Therefore, the drive force is transmitted to the screw conveyor 267 to rotate.

The waste toner T to be recovered into the waste toner container 316 is deposited like a heap inside the container at each lower part below the introduction holes. Therefore, when the screw conveyor 267 is rotated, the screw parts 267*a,* 267*b,* 267*c,* and 267*d* are rotated at the portions heaped with waste toner, and the waste toner heaped at the lower part of the container is conveyed toward the higher position while the heaped waste toner is collapsed. Therefore, it is possible to resolve leakage of the waste toner from the introduction hole 65 and clogging in the conveying pipe 61K, or resolve adhesion of the toner to the container 316. Therefore, the waste toner can be efficiently filled in the container 316.

Figure 13:
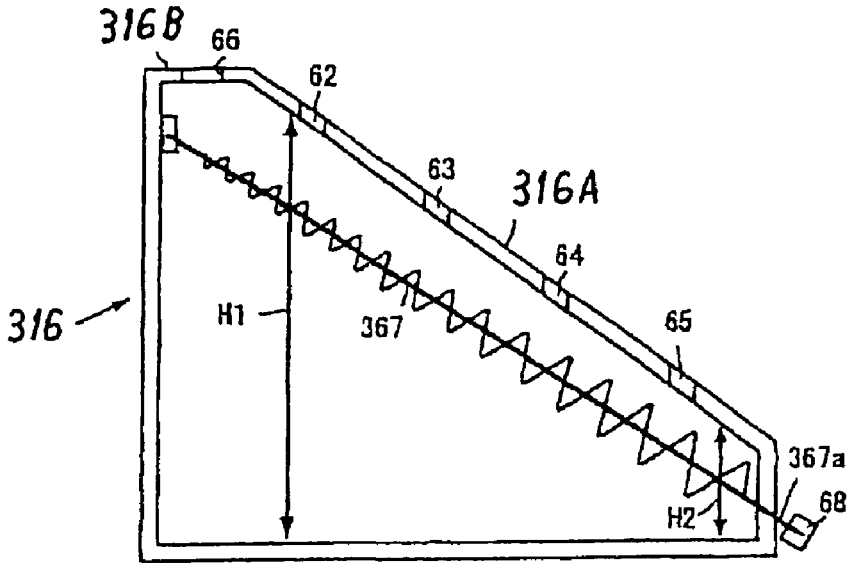
FIG. 13 illustrates a case when a conveyor along which a transfer amount of waste toner is different depending on parts of the member.

FIG. 13 illustrates the structure of the waste toner container when a conveyor in which a transfer amount of waste toner is different depending on parts of the conveyor. The waste toner container 316 has a screw part as the conveyor provided therein. The screw part is formed in such a manner that a transfer amount of waste toner is indirectly proportional to a change in internal height of the container 316, that is, a change in capacity. As shown in FIG. 13, the waste toner container 316 has a relation of H1>H2 where H1 is an internal height of the container on the side of the introduction hole 62 and H2 is the internal height on the side of the introduction hole 65 near the projected end part 367*a* attached to spur gear 68. Therefore, on the side of the introduction hole 65, the waste toner reaches the limit to the amount of toner deposition quicker than that on the hole 62 side. In other words, the top of the heaped waste toner on the hole 65 side touches the internal face of the top face 316A quicker than the top of the heaped waste toner on the hole 62 side touches it.

A screw conveyor 367 shown in FIG. 13 is designed to change a size and a pitch of the screw part so that an amount of toner conveyable per hour is increased larger as a position on the screw conveyor is closer to the introduction hole 65 at the lower position of the container, and that the amount of toner is decreased smaller as a position on the screw conveyor is closer to the introduction hole 62 at the higher position. Therefore, the toner amount to be transferred can be increased at the lower part of the container where the recovered waste toner T is deposited faster than other parts, and the deposited waste toner can be efficiently conveyed toward the higher part. Thus, it is possible to resolve leakage of the waste toner from the introduction hole 65 and clogging in the conveying pipe 61K, or resolve adhesion of the toner to the container 316. Therefore, the waste toner can be efficiently filled in the container 316.

Figure 14:
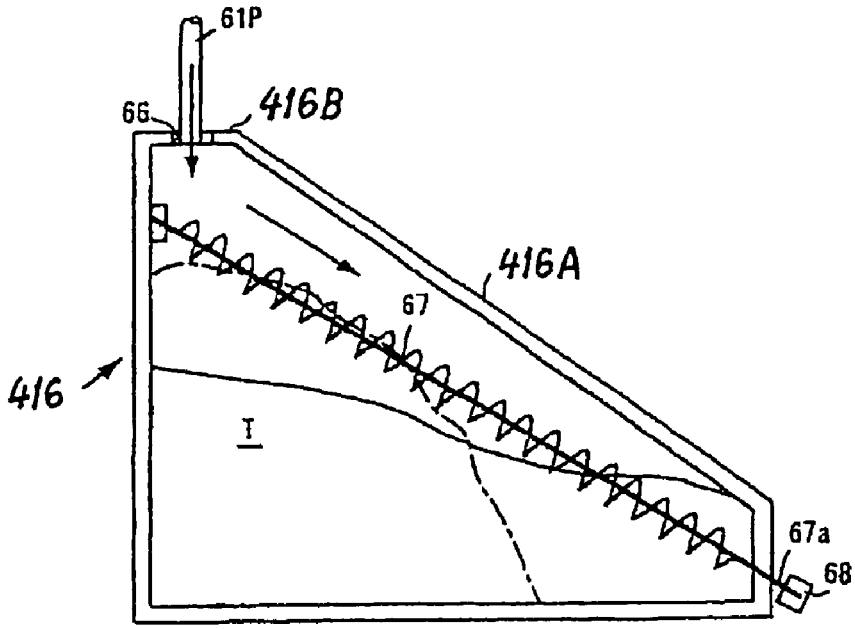
FIG. 14 illustrates a waste toner container in still another embodiment.

FIG. 14 illustrates a waste toner container when an introduction hole is provided on the highest top position of the container. The top of container 416 includes highest top face 416B and slanted top face 416A. A waste toner container 416 as shown in FIG. 14 uses the opening 66 provided on a highest top face 416B as an introduction hole. Like the container 416, if there is one introduction hole 66 that introduces the waste toner T into the container 416, the end parts of the conveying pipes 61Y, 61C, 61M, and 61K are integrated into one as a conveying pipe 61P, and the pipe 61P maybe connected to the introduction hole 66. Further, as shown in FIG. 14, by providing the introduction hole 66 on the highest top face 416B of the container 416, the waste toner is recovered from the highest part of the container 416. Therefore, even if the toner amount is detected by the sensor 21 through the introduction hole 66, it is possible to obtain substantially the same result as the toner amount recovered in the container. Even in this case, however, the recovered waste toner is deposited highest at the lower part right below the introduction hole 66 in the container. Therefore, considering the efficiency of filling the container with toner, it is preferable to rotate the screw conveyor 67 in the direction opposite to the case of FIG. 9 and convey the waste toner toward the side of the end part 67*a,* that is, in the direction away from the introduction hole 66.

Figure 15:
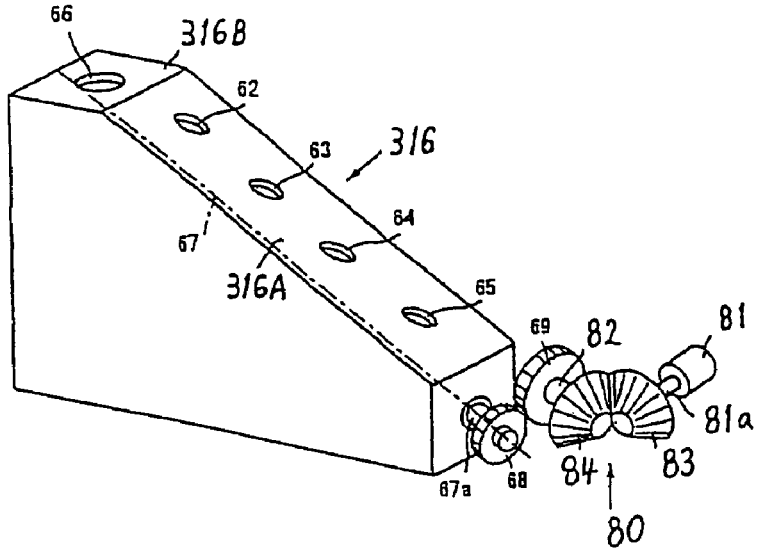
FIG. 15 is a perspective view of a drive unit and a drive transmitting unit in an embodiment.

The waste toner container 316 has a drive unit that drives a conveyor and a drive transmitting unit provided on the outside thereof. FIG. 15 is a perspective view of an embodiment of the drive unit and the drive transmitting unit. The waste toner container 316 shown in FIG. 15 includes the screw conveyor 67, a drive motor 81 that drives the screw conveyor 67 to rotate, and a gear group 80 that transmits the drive force from the drive motor 81 to the screw conveyor 67. The gear group 80 as the drive transmitting unit includes a spur gear 69, a bevel gear 84, and a bevel gear 83. The spur gear 69 is mounted to one end of a shaft 82 provided in parallel with the screw conveyor 67, the bevel gear 84 is mounted to other end of the shaft 82, and the bevel gear 83 is mounted to a drive shaft 81 a of the drive motor 81. The spur gear 69 is engaged with the spur gear 68, and the bevel gear 84 is engaged with the bevel gear 83. The spur gear 69, the bevel gear 84, the bevel gear 83, and drive motor 81 are internally provided in the frame body 100 as shown in FIG. 3. The spur gear 68 is engaged with the spur gear 69 when the waste toner container 316 is set at a predetermined position.

In the waste toner container 316, when the drive motor 81 drives to rotate the drive shaft 81*a,* the drive force is transmitted to the screw conveyor 67 through the bevel gear 84, the spur gear 69, and the spur gear 68 to rotate the screw conveyor 67. By using the gear group 80 in such a manner, drive transmission loss becomes less as compared with the case of using the belt and pulleys, and the screw conveyor 67 can be driven by registering the gears each other when the left-side frame cover 101 is closed.

Figure 16:
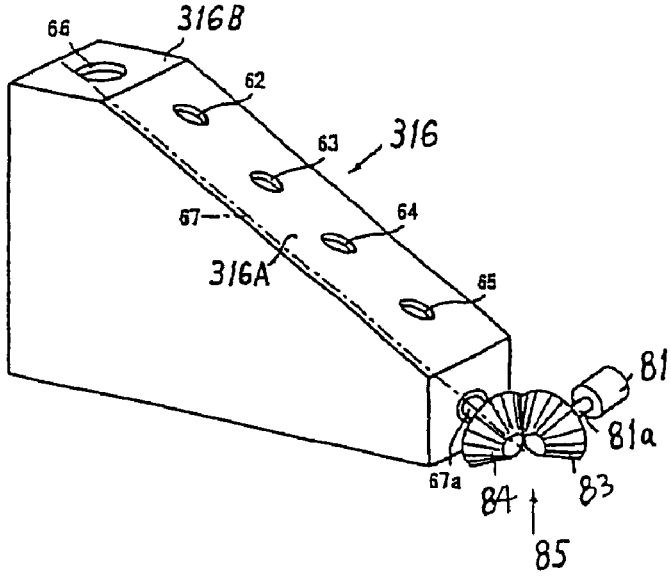
FIG. 16 is a perspective view of a drive unit and a drive transmitting unit in an another embodiment.
Figure 17:
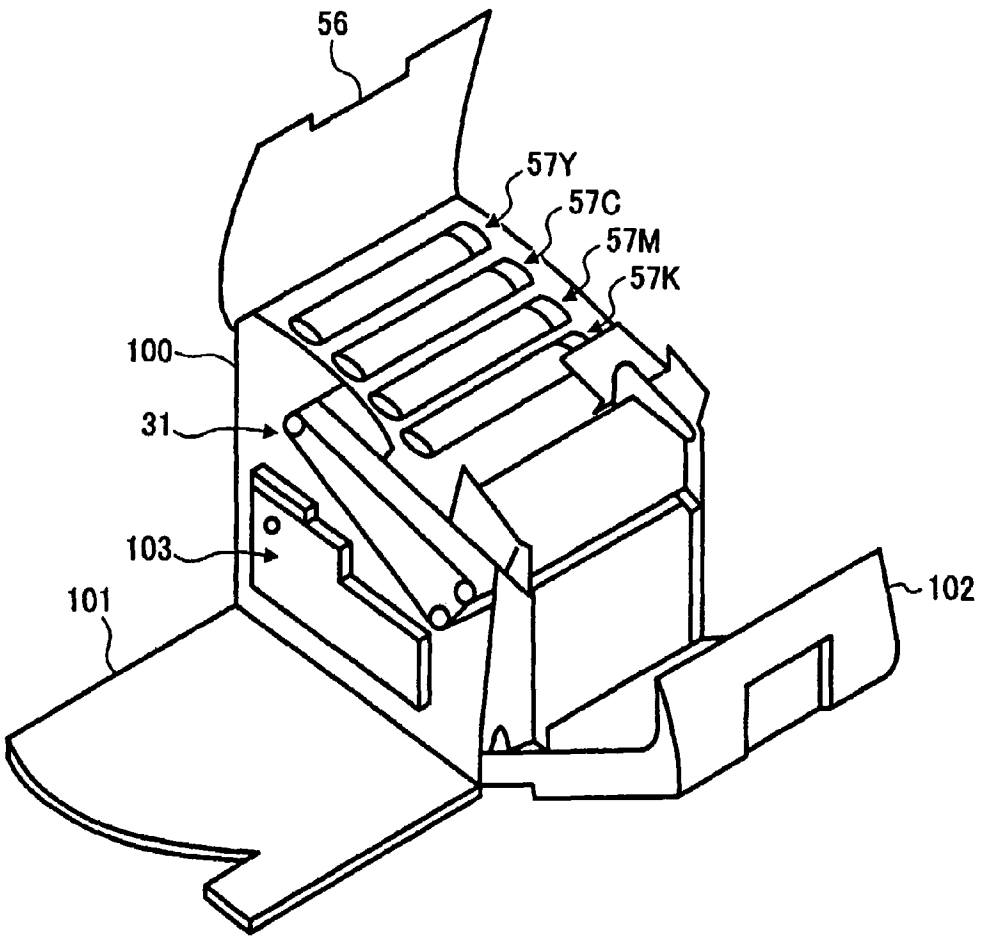
BACKGROUND ART FIG. 17
FIG. 17 is a perspective view of the conventional printer.

FIG. 16 is a perspective view of another embodiment of the drive unit and the drive transmitting unit. The waste toner container 316 includes the screw conveyor 67, the drive motor 81, and a gear group 85 that transmits the drive force of the drive motor 81 to the screw conveyor 67. As shown in FIG. 16, the gear group 85 as the drive transmitting unit includes the bevel gear 84 and the bevel gear 83. The bevel gear 84 is mounted to an end part 67*a* of the screw conveyor 67, and the bevel gear 83 transmits the drive force from the drive motor 81 to the bevel gear 84. The bevel gear 83 is mounted to the drive shaft 81*a* of the drive motor 81. The bevel gear 83 and the drive motor 81 are internally provided in the frame body 100 as shown in FIG. 3. The bevel gear 84 and the bevel gear 83 are disposed so as to be engaged with each other when the left-side frame cover 101 is closed.

According to the waste toner container 316, when the drive motor 81 drives to rotate the drive shaft 81*a,* the drive force is transmitted to the screw conveyor 67 from the bevel gear 83 through the bevel gear 84 to rotate the screw conveyor 67. By using bevel gears for the gear group 85, drive transmission loss becomes less as compared with the case of using the belt and pulleys, and the screw conveyor can be driven by registering the gears when the left-side frame cover 101 is closed.

According to the printer of the embodiment, the waste toner container 16, 116, 216, or 316 is held by the left-side frame cover 101. Therefore, if it is not the time to replace the waste toner container, the container does not need to be dismounted, and therefore, toner drops from the container 16, 116, 216, or 316 can be prevented, thus improving operability and convenience in use.

Furthermore, the waste toner container 16 is integrally formed with the left-side frame cover 101 and is held thereby. Therefore, if the container 16 ensures an estimated capacity for the amount of waste toner to be accommodated therein by the time the life of apparatus itself is ended, there is no need to replace the waste toner container 16 with a new one, which allows improvement of convenience and easy achievement of maintenance free.

Moreover, the waste toner container 116 is detachably attached to the left-side frame cover 101 and is held thereby. Therefore, the capacity of the container 116 can be reduced smaller than that of the container 16 not replaceable, thus achieving space savings.

Furthermore, the window 118 is formed on the waste toner container 116, and therefore, the amount of waste toner accommodated inside the container can be visually checked from outside. Therefore, even if the waste-toner full amount detector is not particularly provided, the user can find out the time to replace the waste toner container 16 and prepare another container in advance. Since the waste-toner full amount detector is not needed, the apparatus can be made cheaper.

Moreover, as a process cartridge, the photoreceptive drum 12, the charger 13, the developing device 14, and the cleaning device 15 for the photoreceptor are integrally supported to form the image forming cartridge 10. In such a structure, the image forming cartridge 10 can easily be detached from the frame body 100 for replacement, thus improving operability. Further, even if the life of the image forming cartridges 10 is elongated, the capacity of the waste toner container on the side of the image forming cartridges 10 does not need to be increased, thus allowing minimization and cost reduction even in the image forming cartridges 10 having long life.

According to the waste toner recovery device of the present invention, if the cleaning device is provided in plurality, height of the recovered waste toner container is inclined in the same direction as a line connecting the cleaning units of the cleaning devices, or the inclination is made parallel with the line. By doing so, the form of the container can be fitted in the shape of the space formed below the cleaning units, thus, efficiently accommodating the container in the apparatus.

The present document incorporates by reference the entire contents of Japanese priority documents, 2002-266886 filed in Japan on Sep. 12, 2002, 2002-285333 filed in Japan on Sep. 30, 2002 and 2003-288678 filed in Japan on Aug. 7, 2003.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus, comprising:

a frame body;

a frame cover supported by the frame body so as to be capable of opening and closing;

an image forming unit that forms a toner image with toner on an image carrier;

a cleaning unit that removes and collects toner residing on the image carrier; and a toner container configured to accumulate the toner collected by the cleaning unit, wherein the toner container is formed integrally with the frame cover such that the frame cover comprises at least one side of the toner container.

2. The image forming apparatus according to claim 1, wherein the toner container has such a structure that the toner in the toner container is visible from outside of the toner container.

3. A process cartridge that is used in an image forming apparatus, the image forming apparatus including a frame body;

a frame cover supported by the frame body so as to be capable of opening and closing;

an image forming unit that forms a toner image with toner on an image carrier;

a cleaning unit that removes and collects toner residing on the image carrier; and a toner container configured to accumulate the toner collected by the cleaning unit wherein the toner container is formed integrally with the frame cover, such that the frame cover comprises at least one side of the toner container, and at least one unit selected from the image forming unit and the cleaning unit is integrally formed with the image carrier, and the process cartridge has an arrangement so that the process cartridge can be detachably attached to the frame body.

4. A waste toner recovery device, comprising:

a toner container, detachably attached to a frame cover of an image forming apparatus, configured to collect waste toner produced in the image formation process by the image forming apparatus, the toner container including a conveying unit for moving the waste toner inside the toner container, wherein the toner container has a shape that fits in a space inside the image forming apparatus.

5. The waste toner recovery device according to claim 4, wherein the toner container has a surface that faces toward a member of the image forming apparatus and the surface is formed in a shape corresponding to a shape of the member.

6. The waste toner recovery device according to claim 5, wherein the member is a cleaning device with a plurality of cleaning units that are aligned in a direction and slantingly with respect to the image forming apparatus, and the surface has a slope in the direction in which the cleaning units are aligned.

7. The waste toner recovery device according to claim 6, wherein the surface is parallel to the cleaning units.

8. The waste toner recovery device according to claim 6, wherein the toner container has a hole at a highest position of the toner container, when the toner container is fit into the image forming apparatus, wherein the hole communicates with the cleaning device so that waste toner collected by the cleaning device accumulates into the toner container via the hole.

9. The waste toner recovery device according to claim 8, wherein an introduction hole is formed on the surface of the container.

10. The waste toner recovery device according to claim 8, the toner container has a side surface, and the hole is formed on the side surface.

11. The waste toner recovery device according to claim 8, wherein the hole communicates with the cleaning device via a conveying path, and the hole is wider than the conveying path.

12. The waste toner recovery device according to claim 6, wherein the toner container has a hole corresponding to each of the cleaning unit, wherein each hole communicates with the corresponding cleaning unit so that waste toner collected by the cleaning unit accumulates into the toner container via the hole.

13. The waste toner recovery device according to claim 12, wherein the holes are formed at regular intervals.

14. The waste toner recovery device according to claim 4, wherein the conveying unit includes a conveyor; and a drive unit that drives the conveyor.

15. The waste toner recovery device according to claim 14, wherein the conveyor conveys the waste toner, coming in the toner container from a hole, away from the hole.

16. The waste toner recovery device according to claim 14, wherein the conveyor conveys the waste toner in the toner container from a relatively lower part to a relatively higher part in the toner container.

17. The waste toner recovery device according to claim 14, wherein the conveyor is a screw conveyor.

* * * * *